US006138692A

United States Patent [19]

Kobos et al.

[11] Patent Number: 6,138,692

[45] Date of Patent: Oct. 31, 2000

[54] CYCLE FOR A DISHWASHER TO REDUCE FILMING

[75] Inventors: Duane M. Kobos, Laporte; Kenneth N. Whah, Porter, both of Ind.; Tony L. Ellis, Bowling Green, Ohio; Ernst Grunewald, Watervliet, Mich.; Ralph E. Christman, Findlay, Ohio

[73] Assignee: Whirlpool Corporation, Benton Harbor, Mich.

[21] Appl. No.: 09/236,161

[22] Filed: Jan. 22, 1999

[51] Int. Cl.[7] ..... B08B 9/20

[52] U.S. Cl. ..... 134/25.2; 134/58 D; 134/34; 134/95.2; 134/95.3

[58] Field of Search ..... 134/25.1, 25.2, 134/25.4, 34, 58 D, 95.2, 95.3, 57 D, 56 D, 18; 34/87, 72, 423

[56] References Cited

U.S. PATENT DOCUMENTS

| | | | |
|---|---|---|---|
| 4,735,219 | 4/1988 | Seeland | 134/56 |
| 5,429,679 | 7/1995 | Young | 134/25.2 |
| 5,560,060 | 10/1996 | Dausch et al. | 134/18 X |
| 5,797,409 | 8/1998 | Cooper et al. | 134/18 |
| 5,836,324 | 11/1998 | Johnson et al. | 134/58 D |
| 5,881,746 | 3/1999 | Buser et al. | 134/58 D |

*Primary Examiner*—Alexander Markoff

*Attorney, Agent, or Firm*—Joel M. Van Winkle; Robert O. Rice; Stephen D. Krefman

[57] ABSTRACT

A method for operating an automatic dishwasher in a manner to minimize the deposition of contaminants or filming on the dishes is provided. The present invention contemplates that objectionable filming on washed dishes or dishware items may occur if residual water left on the dishes at the end of the final drain step is not given a chance to drip off or drain from the dishware. The present invention provides for a drip period following the final drain step in the dishwashing cycle. The drip period provides an opportunity for gravity assisted draining or "drip-off" of residual water from the dishware items prior to evaporation such that the minute particles which are suspended in the residual water are not deposited onto the dishes. During the drip period, rapid evaporation of residual liquid from the dishware items is prevented. This is accomplished, in part, by keeping a vent aperture in the dishwasher door closed for a predetermined time after the final rinse such that the relative humidity remains high in the dishwasher tub and by delaying the energization of the heater such that evaporation is not promoted by the introduction of heat into the dishwasher tub. The present invention further contemplates the use of a purge operation prior to the rinse step wherein a small amount of liquid is supplied into the dishwasher, briefly recirculated and then discharged to drain. The combination of the purge operation with a drip period after the final drain minimizes filming on the dishware items within the dishwasher.

21 Claims, 4 Drawing Sheets

CYCLE FOR A DISHWASHER TO REDUCE FILMING

BACKGROUND OF THE INVENTION

1. Field of the Invention

The present invention relates to automatic dishwashers and more specifically to a cycle or method of operation for an automatic dishwasher wherein the amount of soil particles or film which remains on a dishload at the conclusion of a dishwasher cycle is minimized.

2. Description of the Related Art

Modern automatic dishwashers are designed to receive a soiled dishload, wash the dishes or dishware items, rinse the dishes and then dry the dishes. Accordingly, prior art dishwashing machines or dishwashers have program cycles which include one or more wash steps, one or more rinse steps and a drying period. The wash step or steps are designed to remove soils from the dishes while the rinse step or steps are designed to flush the soils to drain along with detergents used to remove the soils. Prior to each wash or rinse step there is an initial fill period wherein a charge of water is supplied into the dishwasher. Each wash or rinse step comprises a period of pump operation wherein the wash liquid within the dishwasher is recirculated. In a wash step, detergent is added into the dishwasher along with the fill water. After each wash and rinse step, wash liquid is drained from the dishwasher. For example, a common dishwasher cycle may comprise the following: an initial fill step, a wash step, a drain step, a fill step, a rinse step, a drain step, a fill step, a rinse step and a final drain step followed by a drying period.

The number of wash and rinse steps in a dishwasher program cycle may be varied in accordance with the desired cleaning performance. As can be appreciated by one skilled in the art, dishwashing performance may be improved by having more than one wash step and more than one rinse step. However, to minimize water usage, it is desirable to minimize the number of fills or water changes. Accordingly, in the field of dishwasher design, there is a tension between maximizing wash performance and minimizing the amount of water used for an entire program cycle. There is a need, therefore, for dishwasher designs (including program cycle designs) which minimize water consumption but deliver excellent washing performance.

One recognized problem in achieving excellent wash performance is referred to as filming. Filming occurs when film producing contaminants such as minute water borne detergent and soil particles are left on the dishload after the dry period is completed. Generally, film producing contaminants are particles that are present in the liquid of the final rinse step. At the conclusion of the final rinse step, the rinse liquid remaining on the dishload contain these particles. Once the rinse liquid is evaporated during the drying step, the contaminants are deposited on the dishes in the form of an objectionable film or grit.

One of the goals of a rinse cycle in a dishwasher is to rinse the dishes clean of film producing contaminants. However, this is difficult to accomplish with a single rinse step because of the water borne detergents and soil particles which remain in the dishwasher after the drain step which precedes the rinse step. Film producing contaminants remain in the dishwasher after drain primarily in the carry-over wash liquid found in the dishwasher sump. As is well known, dishwasher pumps can not completely pump-out all wash liquid from a dishwasher during drain. A small amount of wash liquid remains in the dishwasher sump as carry-over wash liquid at the conclusion of a drain step. This carry-over wash liquid is a large source of the film producing contaminates which are found in the final rinse step.

One relatively effective way to reduce the amount of film producing contaminants in the final rinse liquid is to provide a dishwasher program cycle which uses more than one rinse step. Unfortunately, additional rinse steps are undesirable due to the aforementioned desire to minimize water usage.

From the above, it can be understood that there exists in the prior art a need for an improved dishwasher cycle which addresses the problem of filming while at the same time recognizes the need to minimize water usage.

SUMMARY OF THE INVENTION

In accordance with the present invention, a method for operating an automatic dishwasher in a manner to minimize the deposition of contaminants or filming on the dishes is provided. The automatic dishwasher of the present invention includes a tub defining an interior wash chamber including a sump located in the lower portion of the tub. A fill valve is connected to an external water supply for supplying liquid into the tub. A pump is operable in a recirculation mode for drawing liquid from the sump and recirculating the liquid through the tub via a spray arm and operable in a drain mode for delivering used liquid to drain. A heater is located in the lower portion of the tub for heating liquid and air in the tub. The tub has an open front which is selectively closed by a door and the door includes a vent aperture. A vent cover associated with an actuator is operable for selectively sealing the vent.

The present invention contemplates that objectionable filming on washed dishes or dishware items may occur if residual water left on the dishes at the end of the final drain step is not given a chance to drip off or drain from the dishware. If evaporation occurs too quickly, then minute particles, which are present in the final rinse and which are suspended in the residual water left on the dishware, will be deposited onto the dishware as an objectionable film.

The present invention is directed to a method for operating an automatic dishwashing machine including the steps of supplying a first quantity of wash liquid, referred to as a wash charge, into the tub and closing the vent aperture in the door. The pump is then operated in a recirculation mode for recirculating the first charge of liquid within the tub during a wash step followed by operating the pump in a drain mode for delivering the first wash charge to drain. A second wash charge of liquid is then supplied into the tub wherein the first and second wash charges are substantially equal charges of approximately 2 gallons each. The pump is operated in a recirculation mode for recirculating the second charge of liquid within the tub during a second wash step followed by operating the pump in a drain mode for delivering the second charge of liquid to drain. Next, a purge charge of liquid is supplied into the tub for rinsing the tub, the volume of the purge charge being less than ¼ the amount of the wash charges or approximately 0.3 gallons. The pump is then operated in a recirculation mode for less than one minute followed by operating the pump in a drain mode for draining the third charge of liquid to drain. A rinse charge of liquid is supplied into the tub, the volume of the rinse charge being substantially equal to the wash charges. The pump is then operated in a recirculation mode for recirculating the rinse charge of wash liquid within the tub during a rinse cycle followed by operating the pump in a drain mode to effect a final drain step. The automatic dishwashing cycle program then executes a drip period wherein the vent aperture is maintained closed and the heater is not energized. After the drip period, the vent aperture in the door is opened and the heater is energized.

Accordingly, it can be understood that the present invention provides for a drip period following the final drain step in the dishwashing cycle. The drip period provides an opportunity for gravity assisted draining or "drip-off" of residual water from the dishware items prior to evaporation such that the minute particles which are suspended in the residual water are not deposited onto the dishes thereby reducing the objectionable filming discussed above. During the drip period, therefore, it is desirable to delay evaporation from the dishware items. This is accomplished, in part, by keeping the vent aperture closed such that the relative humidity remains high in the dishwasher tub and by delaying the energization of the heater such that evaporation is not promoted by the introduction of heat into the dishwasher tub.

The present invention further contemplates the use of a purge operation prior to the rinse step wherein a small amount of liquid is supplied into the dishwasher, briefly recirculated and then discharged to drain. The combination of the purge operation with a drip period after the final drain minimizes filming on the dishware items within the dishwasher.

DESCRIPTION OF THE PREFERRED EMBODIMENT

Figure 1:
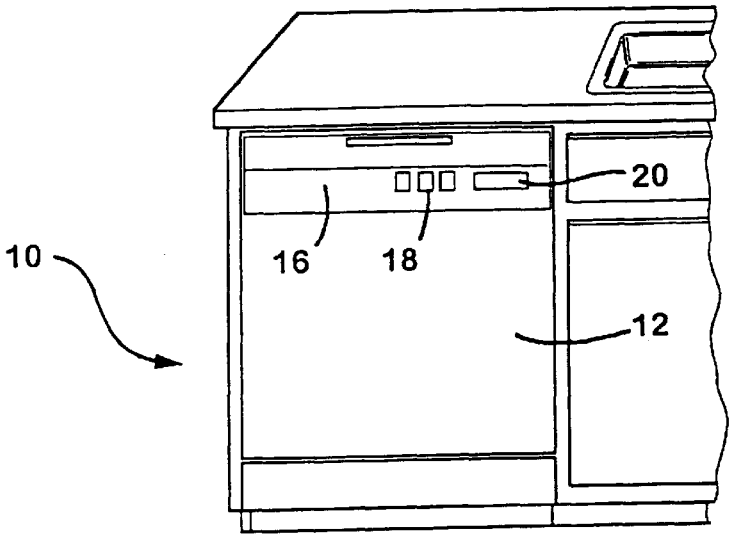
FIG. 1 is front, top, side perspective view of the dishwasher of the present invention installed into a cabinet.
Figure 2:
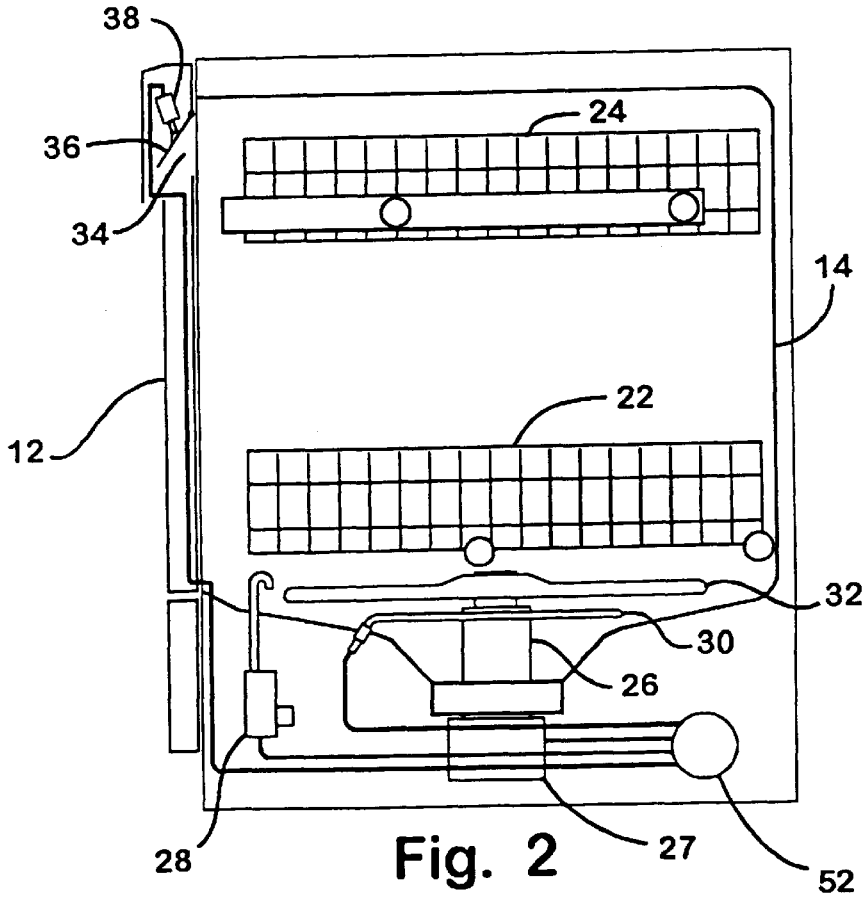
FIG. 2 is a schematic illustration of the dishwasher of FIG. 1 illustrating the major components within the dishwasher.

In the exemplary embodiment of the invention as shown in the drawings, a dishwasher generally designated 10 in FIGS. 1 and 2 includes a front door 12 and a tub 14. The door 12 includes a control console 16 provided with a number of input devices 18, such as switches, to enable a user to select dishwasher cycles and options, and a display 20 to display to the user information on the current status of the dishwasher.

Within the dishwasher tub 14 are dishracks 22, 24 upon which dishware items such as dishes and utensils are placed. Supported in the bottom of the tub 14 is a pump 26 operated by a depending motor 27. Water is inlet into the dishwasher through a fill valve 28. A heater 30 is supported within the lower portion of the tub for heating wash or rinse liquid and air. The pump 26 is operable in a recirculate mode and a drain mode. In the recirculation mode, the pump draws water from the bottom portion of the tub and pumps it up to a wash arm 32 or wash arms such that liquid is sprayed onto the dishes supported on the racks 22, 24. During the drain mode, the pump is operated to send the liquid in the tub 14 to drain.

The door 12 of the dishwasher includes a vent aperture 34. A vent cover 36 is provided adjacent the vent aperture 34 and is connected to an actuator 38 for moving the vent cover 36 to selectively close the vent aperture 34. The vent cover is held in an open position when the actuator 38 is de-energized and is moved to close the vent aperture 34 when the actuator 38 is energized. During the wash cycle of the dishwasher, the vent aperture may be closed to prevent noise, odor and vapors from escaping from the dishwasher. However, during the dry cycle, the vent aperture is opened to allow for water vapor to exit the dishwasher thereby promoting the drying of the dishes within the dishwasher.

Figure 3:
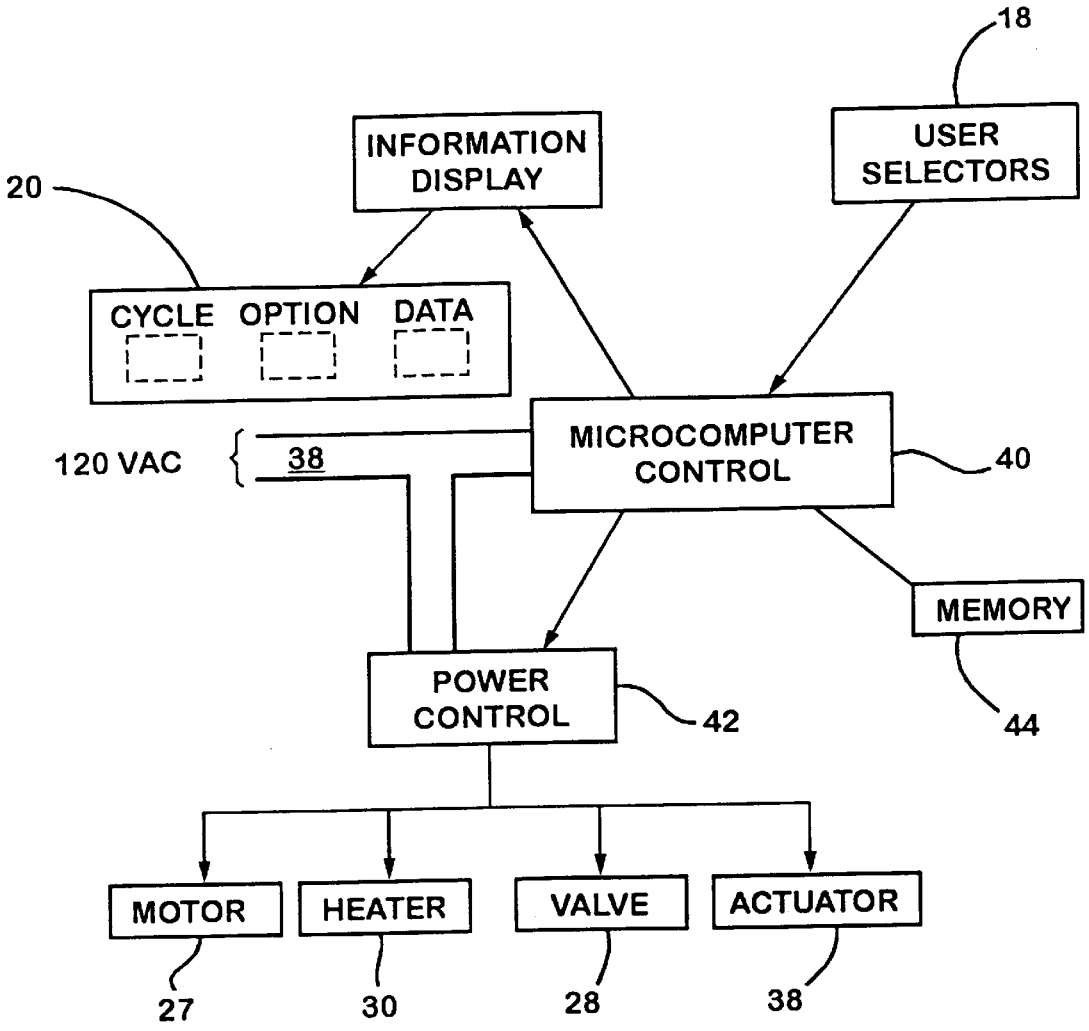
FIG. 3 is a simplified block diagram of a dishwasher control system employed for carrying out the invention.

The operation of the pump within the dishwasher, together with the fill valve 28, heater 30, vent actuator 38 and other necessary components cooperate to carry out a number of different automatic cycles preprogrammed in a control device which, in the preferred embodiment, comprises a microcomputer. As shown in FIG. 3, a microcomputer 40 located preferably within the control console of the door, but locatable elsewhere as well, receives as inputs user selections entered manually by the user at switches 18 on the console 16. The information obtained by the microcomputer 40 from the console 18 is typically in the form of digital signals developed as a function of the status of the switches involved. The microprocessor may receive signals from sensors or other components. The particular cycle and option selected by the user as well as other data are displayed to the user by display unit 20 which may comprise a light emitting diode (LED) display controlled by digital signals applied to it by the microcomputer 40.

The pump motor 27, heater 30, fill valve 28 and actuator 38 are all controlled by the microcomputer 40 through a power controller 42 which may comprise a set of electromechanical relays or other power controlling devices, such as silicon controlled rectifiers (SCRs) or Triacs. Preferably, the power controller 42 is located in the console 16 but for convenience is shown in FIG. 2 in the open space beneath the tub 14.

The microcomputer may be of any conventional type, formed on a integrated circuit. The dishwasher cycles of operation are programmed in a memory 44 addressable by the microcomputer 40.

While a microcomputer is the preferred control means, it is also possible to utilize a timer to operate the components in accordance with predetermined program cycles.

Figure 4:
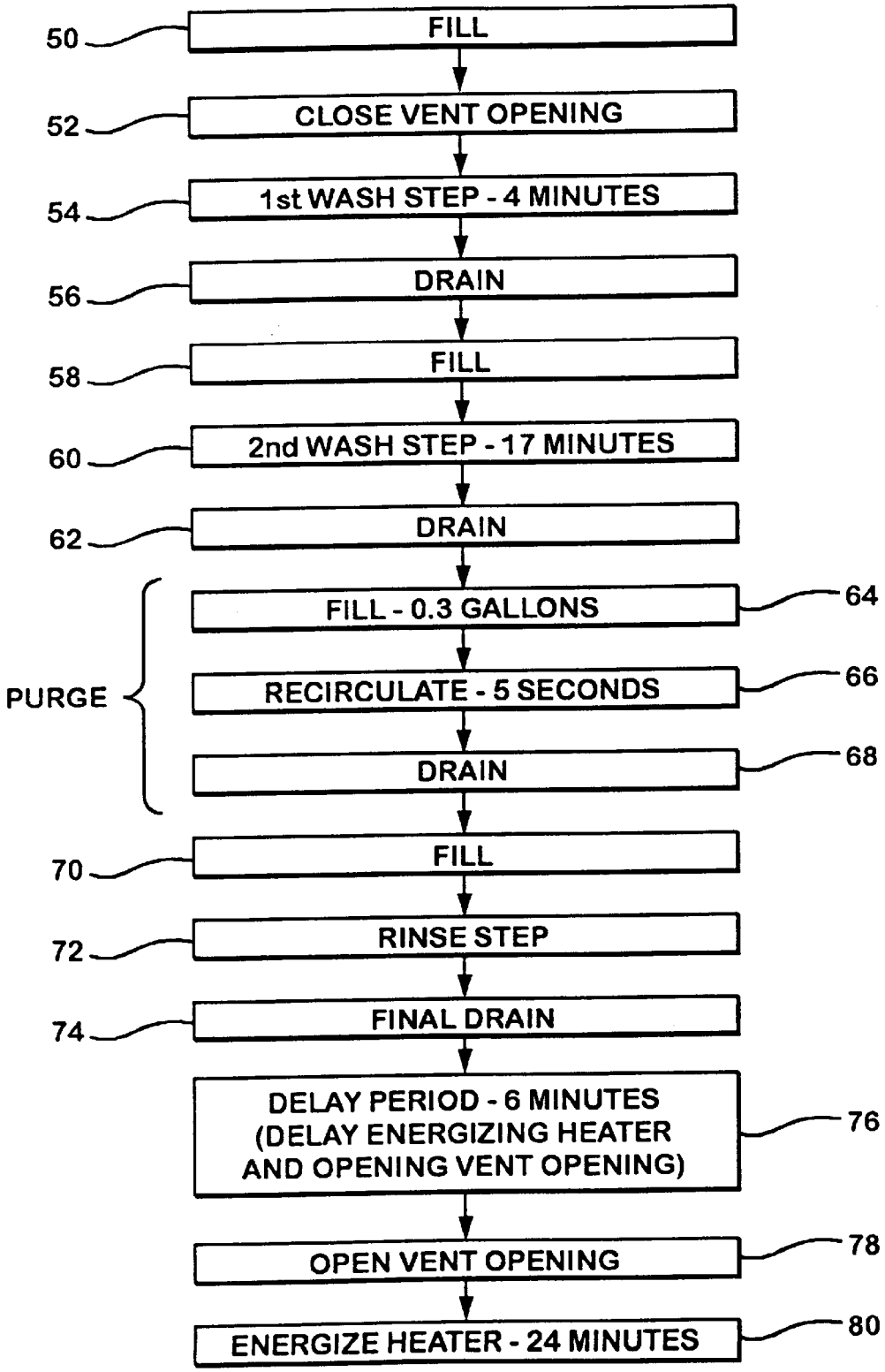
FIG. 4 is a flow chart showing the operation of a dishwasher according to the method of the present invention.

Referring now to FIG. 4, the dishwasher is operated in the following manner. Although the following description will be of a "normal" wash cycle, other wash cycles (i.e., heavy soil cycle, pots and pans cycle) may be selected without departing from the scope of the present invention. Typically, these other cycles differ from a "normal" cycle in that more or longer wash cycles are employed and, thus, the inventive method described herein can be also preferably be employed in these other cycles.

After a quantity of soil laden dishes or dishware items are loaded on the racks 22, 24 within the dishwasher tub 14, the dishwasher user initiates the normal wash cycle. A fill step 50 is executed wherein a predetermined charge or volume of wash liquid, referred to as a wash charge, is introduced into the tub 14, i.e., between 2–2.4 gallons, to be mixed with detergent. The fill step is achieved by energizing the fill valve 28 for a predetermined amount of time, preferably 2 minutes, such that the desired amount of water is supplied into the tub 14. The vent aperture 34 is closed in step 52. Step 52 may be executed prior to step 50, during step 50 or after step 50 but preferably is executed during step 50. Step 52 is achieved by energizing the actuator 38 such that the vent cover 36 is moved to close the vent aperture 34. Closing the vent aperture 34 reduces the noise and moisture that escapes from the tub 14.

The wash charge is mixed with detergent and recirculated through the tub 14 during a first wash step, shown as step 54, for preferably 4 minutes. During the first wash step, wash liquid is pumped to the wash arm 32 and sprayed into the tub 14 onto the dishes loaded onto the dishracks. After the first wash step, the wash charge is drained from the tub, shown in step 56. The drain step 56 is accomplished by operating the motor drain mode for preferably 2 minutes such that the wash liquid is sent to drain. A small amount of carry over liquid is unavoidably left in the tub at the conclusion of the drain step, as the pump 26 is unable to completely pump out all wash liquid from the tub 14.

A second wash charge of liquid is supplied into the tub 14 in step 58, in a similar manner to step 50. The second wash charge is mixed with detergent and the liquid is recirculated through the tub 14 during a second wash step, shown as step 60. This second wash step 60 is preferably 17 minutes long. After the second wash step, the wash liquid is drained from the tub, shown in step 62. Like step 56, a small amount of carry over liquid is unavoidably left in the tub at the conclusion of the drain step 62, as the pump 26 is unable to completely pump out all wash liquid from the tub 14.

Following the end of the second wash step, and before the rinse step, a short purge period comprising steps 64, 66 and 68 is performed. The purge begins by energizing the fill valve 28 for a short fill period, preferably about 25 seconds, to inlet a small amount or charge of fresh purge water into the tub 14. The total amount of the purging charge introduced during step 64 is preferably around 0.3 gallons. Following the short fill step 64, the pump 26 is operated in a recirculation mode in step 66. Due the limited amount of liquid in the tub, the pump 26 is unable to optimally pump liquid throughout the tub 14, however, some amount of pumping will occur resulting in a limited amount of liquid recirculation throughout the tub 14. This recirculation period, step 66, is performed for only a limited amount of time, preferably about 5 seconds. The pump 26 is then operated in a drain mode, step 68, for approximately 2 minutes.

In step 70, the fill valve is energized to inlet a rinse charge. The pump 26 is then operated in a recirculation mode for a period of time, preferably less than 10 minutes such that the dishes are rinsed during rinse step 72. The rinse step 72 is followed by a final drain period 74 for approximately 2 minutes.

After the conclusion of the final drain step 74, the dishwasher enters a drip period 76. The drip period is preferably 6 minutes but could be shorter or longer. As discussed above, film producing contaminants are present in the final rinse and in the residual water left on the dishwasher items at the end of the final drain. The present invention contemplates that objectionable filming on washed dishes or dishware items may occur if residual water left on the dishes at the end of the final drain step is not given a chance to drip off or drain from the dishware. If evaporation occurs to quickly, then the minute particles which are suspended in the residual water left on the dishware are deposited onto the dishware as an objectionable film.

The drip period 76 provides an opportunity for gravity assisted draining or "drip-off" of residual water from the dishware items prior to evaporation such that the minute particles which are suspended in the residual water are not deposited onto the dishes thereby reducing the objectionable filming discussed above. During the drip period 76, therefore, it is desirable to delay evaporation from the dishware items. This is accomplished, in part, by keeping the vent aperture 34 closed such that the relative humidity remains high in the dishwasher tub 14. Moreover, the heater 32 is not energized during the drip period 76 as energizing the heater 32 would promote undesirable evaporation during the drip period by radiating heat onto the dishware items and by lowering the relative humidity within the dishwasher tub 14.

Figure 5:
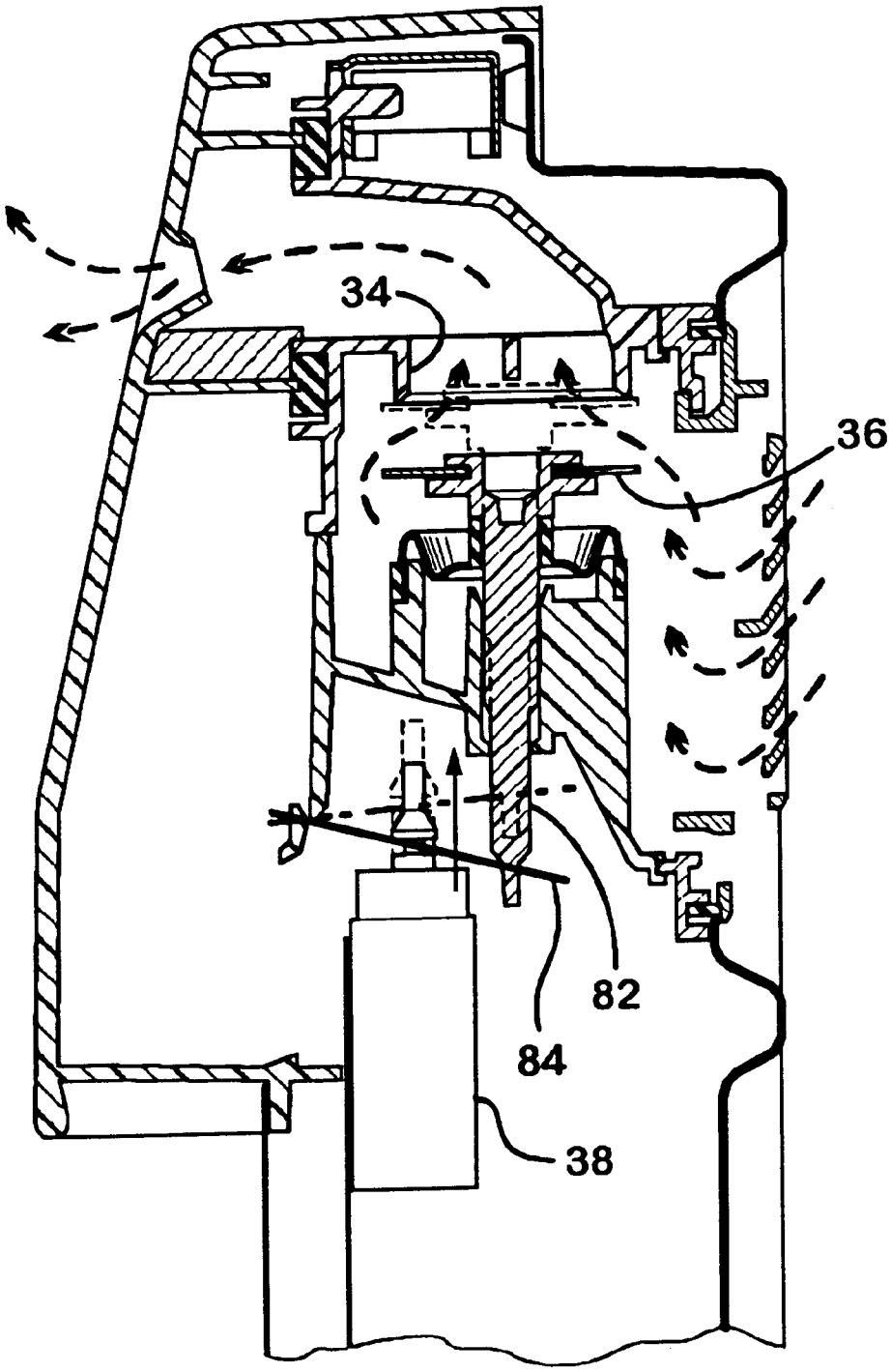
FIG. 5 is an enlarged, side sectional view of the door vent area of the dishwasher of FIG. 1.

After the drip period 76, the dishwasher proceeds to open the vent aperture 34, shown as step 78. This is achieved by de-energizing the actuator 38 such that the vent cover 36 is moved to an open position to open the vent aperture 34. FIG. 5 illustrates an embodiment of the vent aperture 34 area. The vent aperture 34 is provided in the door. An actuator 38, preferably a wax motor, is shown linked to a rectilinearly movable shaft 82 via a transfer spring 84. A wax motor is well known device which includes a heating device to heat a thermally expansible material such as a high melting point wax to produce a linear movement of an actuator element—see for example U.S. Pat. No. 4,691,516. A vent cover 36, preferably a flexible seal-like member, is mounted to the shaft 82. Actuation of the wax motor 38 causes the shaft 82 to move upward such that the vent cover 36 is seated on the vent aperture 34 to close the vent aperture. When the wax motor is de-energized, the shaft 82 is moved downward, unseating the vent cover 36 from the vent aperture 34.

It can be understood that with the use of a wax motor, there is a delay between de-energization of the wax motor 38 and the subsequent opening of the vent aperture 34. This is due to the thermal lag associated in a wax motor actuator with the cooling of the thermally expansible wax. This delay between de-energization and actual movement of the actuator may be between 1–2 minutes.

While the above description discloses a particular vent arrangement for a dishwasher, the present invention is not limited to this particular disclosure. Rather, the present invention discloses a method for operating a dishwasher which is compatible with any dishwasher having an active vent system wherein the vent aperture can be selectively opened and closed. For example, the present invention may be practiced with an active vent system as disclosed in U.S. Pat. No. 5,836,324.

As presently contemplated by the inventors, step 78 may refer to the actual opening of the vent aperture 34 or it may refer to the de-energization of the actuator 38. If in step 78 the wax motor 38 is de-energized after the drip period, the vent aperture will not actually open for 1–2 minutes after the conclusion of the drip period 76. If it is desired to have the vent aperture 34 open at the conclusion of the drip period, the wax motor 38 should be de-energized prior the end of the drip period 76. Of course, other actuators, such as a solenoid, may be used which provide a more immediate reaction to de-energization.

In addition to opening the vent aperture 34 after the drip period, the heater 32 is energized, as shown at step 80. Step 80 may occur at the same time as step 78 or shortly before or after step 78. As is well understood, operation of the heater 32 inputs heat into the dishwasher tub which heats the dishware items and air within the dishwasher thereby promoting evaporation and the drying of the dishes.

It can be understood, therefore, that present invention is directed to a dishwasher cycle which is configured to minimize the amount of water used in an entire dishwasher cycle while at the same time preventing undesirable filming on the dishes at the conclusion of the wash cycle. This is achieved by executing a purge step after the final wash step to reduce the amount of minute particles in the carry over water going into the rinse step. Moreover, a unique drip period is provided to promote the draining of residual water from the dishes at the conclusion of the rinse step prior to taking steps to promote evaporation within the dishwasher tub.

While the present invention has been described with reference the above described embodiment, those of skill in the Art will recognize that changes may be made thereto without departing from the scope of the invention as set forth in the appended claims.

We claim:

1. A method for operating an automatic dishwashing machine, the dishwashing machine including a tub defining an interior wash chamber for receiving dishware items, a sump being located in the lower portion of the tub, a fill valve connected to an external water supply for supplying liquid into the tub, a pump operable in a recirculation mode for drawing liquid from the sump and recirculating the liquid through the tub via a spray arm and operable in a drain mode for delivering liquid within the tub to drain, a heater located in the lower portion of the tub for heating liquid and air in the tub, the tub having an open front which is selectively closed by a door, the door having a vent aperture, a vent cover associated with an actuator for selectively opening and closing the vent aperture, the method comprising the steps of:

supplying a wash charge of liquid into the tub;

closing the vent aperture in the door;

operating the pump in a recirculation mode for recirculating the wash charge of liquid within the tub during a wash cycle;

operating the pump in a drain mode for delivering the wash charge of liquid to drain;

supplying a purge charge of liquid into the tub for rinsing the tub, the purge charge being less than ¼ the amount of the wash charge;

operating the pump in a recirculation mode for less than one minute;

operating the pump in a drain mode for delivering the purge charge of liquid to drain;

supplying a rinse charge of liquid into the tub, the quantity of the rinse charge being substantially equal to the wash charge;

operating the pump in a recirculation mode for recirculating the rinse charge of wash liquid within the tub during a rinse cycle;

operating the pump in a drain mode to effect a final drain step; and actuating the actuator a predetermined delay period after the end of the final drain step for opening the vent aperture in the door such that the vent remains closed for a predetermined drip period after the final drain step.

2. The method of operating an automatic dishwashing machine according to claim 1, further wherein the predetermined drip period during which the vent aperture remains closed after the final drain step is greater than four minutes.

3. The method of operating an automatic dishwashing machine according to claim 1, further comprising the step of:

energizing the heater after the drip period for supplying heat into the dishwasher tub.

4. The method of operating an automatic dishwashing machine according to claim 1, further wherein the step of closing the vent aperture occurs during the first liquid supplying step.

5. The method of operating an automatic dishwashing machine according to claim 1, further wherein the step of closing the vent aperture occurs prior to the first liquid supplying step.

6. The method of operating an automatic dishwashing machine according to claim 1, further comprising the step of:

supplying a second wash charge of liquid into the tub after the first drain step;

operating the pump in a recirculation mode for recirculating the first charge of liquid within the tub during a wash cycle; and operating the pump in a recirculation mode for delivering the second wash charge to drain.

7. The method of operating an automatic dishwashing machine according to claim 1, further wherein the wash and rinse charges of liquid are each more than 2 gallons of water and the purge charge is less than ½ gallon of water.

8. The method of operating an automatic dishwashing machine according to claim 1, further wherein the dishwashing machine has a wash pump and a drain pump, the wash pump being used to effect the recirculation mode and the drain pump being used to effect the drain mode.

9. The method of operating an automatic dishwashing machine according to claim 1 wherein the actuator comprises a wax motor which is linked to the vent cover, the method further comprising the steps of:

energizing the wax motor to close the vent aperture; and de-energizing the wax motor after a predetermined delay after the end of the final drain step such that the vent aperture is subsequently opened after the wax motor cools.

10. The method of operating an automatic dishwashing machine according to claim 1 wherein the actuator comprises a wax motor which is linked to the vent cover, the method further comprising the steps of:

energizing the wax motor to close the vent aperture prior to or during the first wash liquid supply step; and de-energizing the wax motor after a predetermined delay of approximately 6 minutes after the end of the final drain step such that the vent aperture is subsequently opened after the wax motor cools.

11. A method for operating an automatic dishwashing machine, the dishwashing machine including a tub defining an interior wash chamber for receiving dishware items, a sump being located in the lower portion of the tub, a fill valve connected to an external water supply for supplying liquid into the tub, a pump operable in a recirculation mode for drawing liquid from the sump and recirculating the liquid through the tub via a spray arm and operable in a drain mode for delivering liquid within the tub to drain, a heater located in the lower portion of the tub for heating liquid and air in the tub, the tub having an open front which is selectively closed by a door, the door having a vent aperture, a vent cover associated with an actuator for selectively opening and closing the vent aperture, the method comprising the steps of:

supplying a wash charge of liquid into the tub;

closing the vent aperture in the door;

operating the pump in a recirculation mode for recirculating the wash charge of liquid within the tub during a wash cycle;

operating the pump in a drain mode for delivering the wash charge of liquid to drain;

supplying a rinse charge of liquid into the tub;

operating the pump in a recirculation mode for recirculating the rinse charge of wash liquid within the tub during a rinse cycle;

operating the pump in a drain mode to effect a final drain step;

actuating the actuator a first predetermined delay period after the end of the final drain step for opening the vent aperture in the door such that the vent remains closed for a predetermined drip period after the final drain step; and energizing the heater for heating the dishware items and air within the tub after a second predetermined delay period after the end of the final drain step such that the heater remains de-energized for at least part of the predetermined drip period after the final drain step.

12. The method of operating an automatic dishwashing machine according to claim 11, further wherein the predetermined drip period during which the vent aperture remains closed after the final drain step is greater than five minutes.

13. The method of operating an automatic dishwashing machine according to claim 11, further wherein the step of closing the vent aperture occurs during the first liquid supplying step.

14. The method of operating an automatic dishwashing machine according to claim 11, further wherein the step of closing the vent aperture occurs prior to the first liquid supplying step.

15. The method of operating an automatic dishwashing machine according to claim 11, further comprising the step of:

supplying a second wash charge of liquid into the tub after the first drain step, the second wash charge being substantially equal to the first wash charge;

operating the pump in a recirculation mode for recirculating the first charge of liquid within the tub during a wash cycle; and operating the pump in a recirculation mode for delivering the second wash charge to drain.

16. The method of operating an automatic dishwashing machine according to claim 15, further comprising the steps of:

supplying a purge charge of liquid into the tub for rinsing the tub after the second drain step, the purge charge being less than ¼ the amount of the wash charges;

operating the pump in a recirculation mode for less than one minute; and operating the pump in a drain mode for delivering the purge charge of liquid to drain.

17. The method of operating an automatic dishwashing machine according to claim 11 wherein the first predetermined delay period and the second predetermined delay period are substantially equal.

18. The method of operating an automatic dishwashing machine according to claim 17 wherein the first and second predetermined delay periods are more than 5 minutes.

19. The method of operating an automatic dishwashing machine according to claim 11, further wherein the dishwashing machine has a wash pump and a drain pump, the wash pump being used to effect the recirculation mode and the drain pump being used to effect the drain mode.

20. The method of operating an automatic dishwashing machine according to claim 11 wherein the actuator comprises a wax motor which is linked to the vent cover, the method further comprising the steps of:

energizing the wax motor to close the vent aperture; and de-energizing the wax motor after the first predetermined delay period after the end of the final drain step such that the vent aperture is subsequently opened after the wax motor cools.

21. The method of operating an automatic dishwashing machine according to claim 11 wherein the actuator comprises a wax motor which is linked to the vent cover, the method further comprising the steps of:

energizing the wax motor to close the vent aperture prior to or during the first wash liquid supply step; and de-energizing the wax motor after the first predetermined delay period of approximately 6 minutes after the end of the final drain step such that the vent aperture is subsequently opened after the wax motor cools.

* * * * *